US008047156B2

(12) United States Patent
Giri et al.

(10) Patent No.: US 8,047,156 B2
(45) Date of Patent: Nov. 1, 2011

(54) DICE WITH POLYMER RIBS

(75) Inventors: Manish Giri, Corvallis, OR (US); Arun K. Agarwal, Corvallis, OR (US); Bradley D. Chung, Corvallis, OR (US); Jeremy Harlan Donaldson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 943 days.

(21) Appl. No.: 11/825,017

(22) Filed: Jul. 2, 2007

(65) Prior Publication Data

US 2009/0011185 A1 Jan. 8, 2009

(51) Int. Cl.
*B05B 7/00* (2006.01)

(52) U.S. Cl. ..... 118/300; 216/27; 216/41; 216/56

(58) Field of Classification Search ..... 118/300; 216/27, 41, 56
See application file for complete search history.

(56) References Cited

U.S. PATENT DOCUMENTS

| | | | | |
|---|---|---|---|---|
| 3,496,333 | A * | 2/1970 | Kilby et al. | 347/209 |
| 5,308,442 | A | 5/1994 | Taub et al. | |
| 5,387,314 | A | 2/1995 | Baughman et al. | |
| 5,463,412 | A | 10/1995 | Matsuda | |
| 5,509,200 | A * | 4/1996 | Frankeny et al. | 29/852 |
| 6,019,907 | A | 2/2000 | Kawamura | |
| 6,164,762 | A | 12/2000 | Sullivan et al. | |
| 6,375,313 | B1 | 4/2002 | Adavikolanu et al. | |
| 6,412,921 | B1 | 7/2002 | Manini | |
| 6,648,454 | B1 | 11/2003 | Donaldson et al. | |
| 6,672,712 | B1 | 1/2004 | Donaldson et al. | |
| 6,779,875 | B2 | 8/2004 | Pawlowski, Jr. et al. | |
| 6,930,055 | B1 | 8/2005 | Bhowmik et al. | |
| 6,972,240 | B2 | 12/2005 | Poveda | |
| 7,040,735 | B2 | 5/2006 | Donaldson et al. | |
| 2003/0111011 | A1 * | 6/2003 | Gibson et al. | 118/410 |
| 2004/0084396 | A1 * | 5/2004 | Donaldson et al. | 216/2 |
| 2004/0201111 | A1 * | 10/2004 | Thurgood | 257/782 |
| 2005/0219327 | A1 * | 10/2005 | Clarke et al. | 347/65 |
| 2005/0236358 | A1 | 10/2005 | Buswell | |

OTHER PUBLICATIONS (Butta, E.; Petris, S; Pasquani, M., J. Appl. Polym. Sci., 13, 1073-1081 (1969)).*
Wormtan (Wortman, J. J. and Evans, R., A., J. Appl. Phys., 36, 153-156 (1965)).*
Butta, E.; Petris, S; Pasquani, M., J. Appl. Polym. Sci., 13, 1073-1081 (1969).*
Wortman, J. J. and Evans, R., A., J. Appl. Phys., 36, 153-156 (1965).*
Allen, M. G.; Mehregany, M.; Howe, R. T.; Senturia, S. D., Appl. Phys. Lett. 51(4), 241-243 (1987).*
Hauch, J. A.; Holland, D.; Marder, M. P.; and Swinney, H. L.; Phys. Rev. Lett. 82(9), 3823-3826 (1999).*
Allen (Allen, M. G.; Mehregany, M.; Howe, R. T.; Senturia, S. D., Appl. Phys. Lett. 51(4), 241-243 (1987)).*
Hauch (Hauch, J. A.; Holland, D.; Marder, M. P.; and Swinney, H. L.; Phys. Rev. Lett. 82(9), 3823-3826 (1999)).*

* cited by examiner

*Primary Examiner* — Dah-Wei Yuan
*Assistant Examiner* — Albert Hilton

(57) ABSTRACT

The present disclosure is drawn to dice with polymer ribs. In one example, a die structure can comprise a die having a plurality of die slots, the die having polymer ribs attached to one side thereof, wherein the polymer ribs are attached using a polymer film on one side of the die, said polymer film having portions removed along the die slots to form the polymer ribs which bridge the die slots, thereby forming a plurality of polymer bridged die slots.

13 Claims, 5 Drawing Sheets

DICE WITH POLYMER RIBS

INTRODUCTION

Printhead dice contain the integrated circuitry used to control the jetting of ink for printing. They also generally contain slots that are used to effectuate the transfer of ink from the ink tank or storage unit to the emission or nozzle components, providing for the flow of ink during printing applications. Such slots are detrimental to the overall strength of the die, likely weakening the die. Such weakening increases the die's fragility and frequently causes die breakage or structural damage (fracture, delamination) in the fluidic architecture region. Die breakage leads to ink shortage, electrical failures, and reduced pen yield, further leading to costly expenditures and lost work time or productivity, which can hamper overall printing efficiency.

BRIEF DESCRIPTION OF THE DRAWINGS

Additional features and advantages of the disclosed subject matter will be apparent from the detailed description which follows, taken in conjunction with the accompanying drawings, which together illustrate, by way of example, features of the present disclosure; and, wherein.

Figure 1:
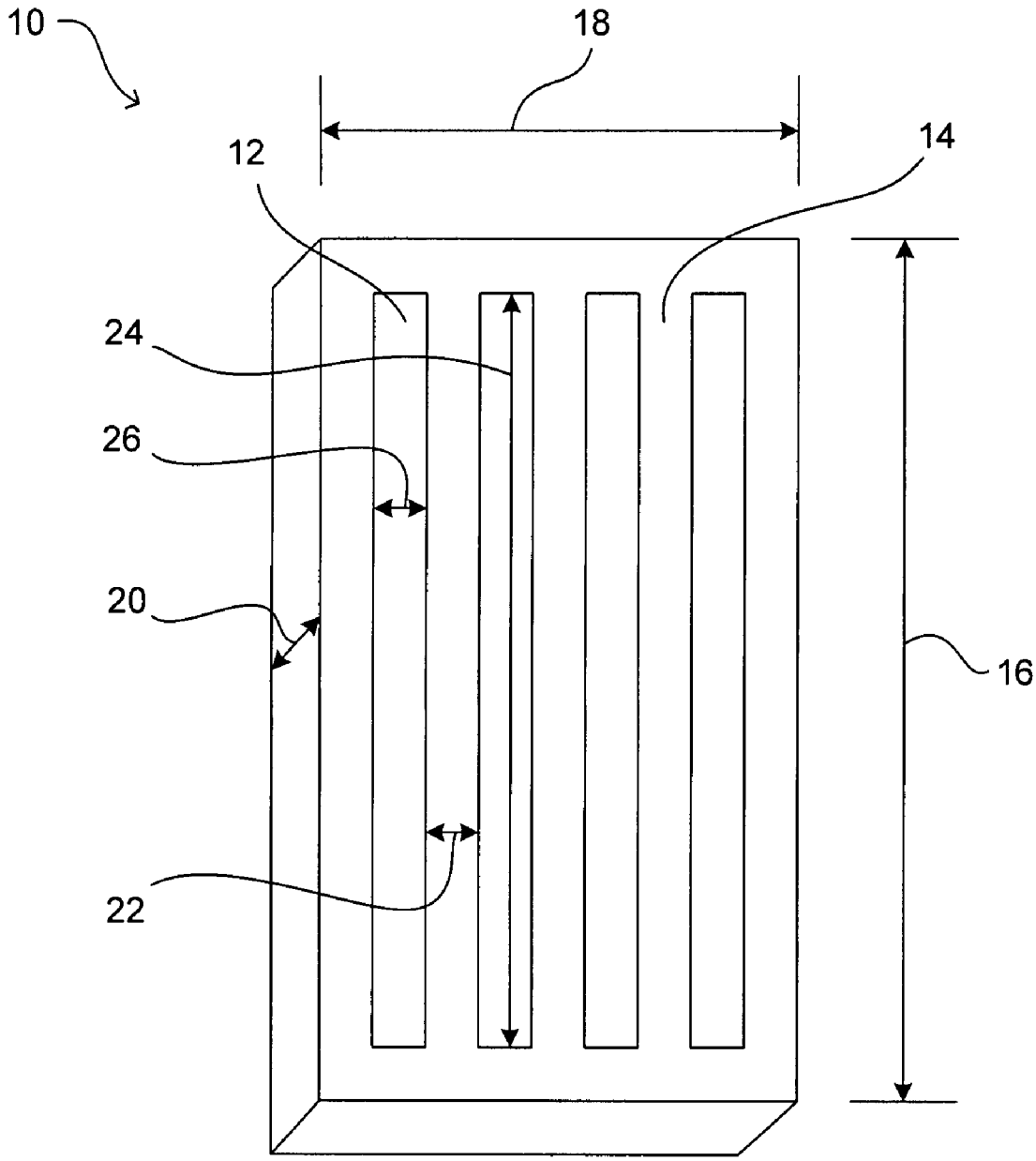
FIG. 1 is a predominately overhead three dimensional schematic view of an embodiment of a slotted die in accordance with an embodiment of the present disclosure.

Reference will now be made to the exemplary embodiments illustrated, and specific language will be used herein to describe the same. It will nevertheless be understood that no limitation of the scope of the present disclosure is thereby intended.

DETAILED DESCRIPTION

Before the subject matter of this application is disclosed and described, it is to be understood that the present disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present disclosure is intended to be limited only by the appended claims and equivalents thereof.

It should be noted that, as used in this specification and the appended claims, the singular forms "a," "an," and "the" include plural referents unless the context clearly dictates otherwise.

As used herein, "fluid ejection cartridge" refers to an enclosed device for storing and dispersing a fluid. Such a device typically has a nozzle and an ejector. This term includes printing cartridges used in ink-jet printing.

As used herein, "substantial" or "substantially" when used in reference to a quantity or amount of a material, or a specific characteristic thereof, refers to an amount that is sufficient to provide an effect that the material or characteristic was intended to provide. The exact degree of deviation allowable may in some cases depend on the specific context.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include the numerical values explicitly recited as the limits of the range and also to include all the individual numerical values or sub-ranges encompassed within that range as if each numerical value and sub-range is explicitly recited. As an illustration, a numerical range of "about 1 wt % to about 5 wt %" should be interpreted to include the explicitly recited values of about 1 wt % to about 5 wt % and also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting one numerical value but not other numerical values. Furthermore, such an interpretation should apply regardless of the breadth of the range or the characteristics being described.

The present disclosure is drawn to compositions and methods having a die with polymer ribs attached thereto. It is noted that when discussing a reinforced die structure or a method of making such a die, each of these discussions can be considered applicable to each of these embodiments, whether or not they are explicitly discussed in the context of that embodiment. Thus, for example, in discussing the polymer ribs present in a reinforced die structure, those polymer ribs can also be used in a method for making such die structures, and vice versa.

As such, with these definitions in mind, the present disclosure provides a reinforced die structure having a die with a plurality of die slots. The die has polymer ribs attached to one side such that the polymer ribs form polymer bridges as the polymer spans the slots of the die at discrete locations, thereby forming a plurality of polymer bridged die slots.

In another embodiment, a method of making a reinforced die structure for use in a printing apparatus can include slotting a die to form a plurality of die slots, and attaching polymer ribs to one side of the die. The polymer ribs can form polymer bridges as the polymer spans the slots of the die at discrete locations, thereby forming a plurality of polymer bridged die slots.

The die used in accordance with the compositions and methods of the present disclosure can be any slotted die that is used in conjunction with ink printing. In one embodiment, the die can be used in ink-jet printing. Generally, the die can be slotted by mechanical or chemicals means. For example, the die can have material removed by cutting, milling, laser ablation, or etching, such that slots are formed for ink passage in a printing apparatus. The die can be manufactured from a number of materials, e.g., silicon or glass. In one embodiment the die can be a silicon die. Generally, any material can be used that provides a Young's modulus of at least about 50 GPa. In one embodiment, the Young's modulus can be at least about 150 GPa. Typically, the die can be rectangular although various shapes are considered within the scope of the present disclosure. For example, the die can be round, square, or oval. Other shapes, such as custom or intricate shapes, may also be used with the methods and compositions described herein.

Referring now to FIG. 1, as shown generally at 10, the die structure 14 can be substantially rectangular. In one embodiment, the die structure can have a length 16 of about 10 mm to about 50 mm and a width 18 of about 1 mm to about 5 mm, with a thickness 20 of about 0.2 mm to about 1 mm. Typically, the die structure can contain a plurality of slots 12. The number of slots can be determined by one skilled in the art based on the ink demands of the printing system. In one embodiment, the number of slots can be 2 to 6. The die can have slots orientated in various configurations. In one embodiment, as shown in FIG. 1, the slots can be substantially parallel. Additionally, the dies can have slots of various shapes, e.g., the slots can be rectangular or oval. In one embodiment, the slots are substantially rectangular. The slots can also be configured in various three dimensional geometries. For example, the slots can have a trapezoidal configuration such that the walls of the slots have a wider base than top or vice versa. In one embodiment, the slots can have a substantially rectangular geometry. Further, the die can have slots that are spaced at a distance 22 from about 0.3 mm to about 2.0 mm apart. Additionally, the slots can have a length 24 from about 10 mm to about 70 mm and a width 26 from about 50 μm to about 500 μm. In one embodiment, the slots may have a width 26 μm of about 200 μm.

The polymer ribs used in accordance with the methods and compositions of the present disclosure can reinforce the slotted die. The polymer ribs can be manufactured from a number of polymer materials including, but not limited to, polyimides, epoxies, thermoplastics, combinations thereof, and other multilayer polymer composites. In one embodiment, the polymer can be a polyimide. In another embodiment, the polymer can be any photoimageable polymer. A photoimageable polymer includes three major components: a photo active compound that undergoes cross-linking polymerization reaction on exposure to the suitable radiation, a photo packaging compound that initiates the radical polymerization and a solvent or a binder that carries both the photo active and photo packaging compounds either in a liquid or in a solid form. The photoimageable polymers can be referred by their trade names IJ5000 series Barrier material, SU-8 photoresists, and EC series photoresists. These chemicals are supplied by DuPont and Microchem companies, respectively. Photoimageable polymers can include photo active compounds such as, but not limited to, methacrylate esters, urethane derivatives and epoxy derivatives; photo packaging compounds such as, but not limited to, aryl sulfonium salts; solvents and binders such as, but not limited to, polymethyl metacrylate, and γ-Butyrolactone.

Generally, the polymer can be any polymer that has a Young's modulus of at least about 2 GPa. In one embodiment, the Young's modulus can be at least about 10 GPa. The polymer ribs can be configured to have various shapes that can help vent the ink or that can reduce the amount of bubbles or air pockets that are trapped in the ink. In one embodiment, the polymer ribs can have at least one side that has a concave shape. In another embodiment, the polymer ribs can have at least one side that has a flat shape.

Figure 2:
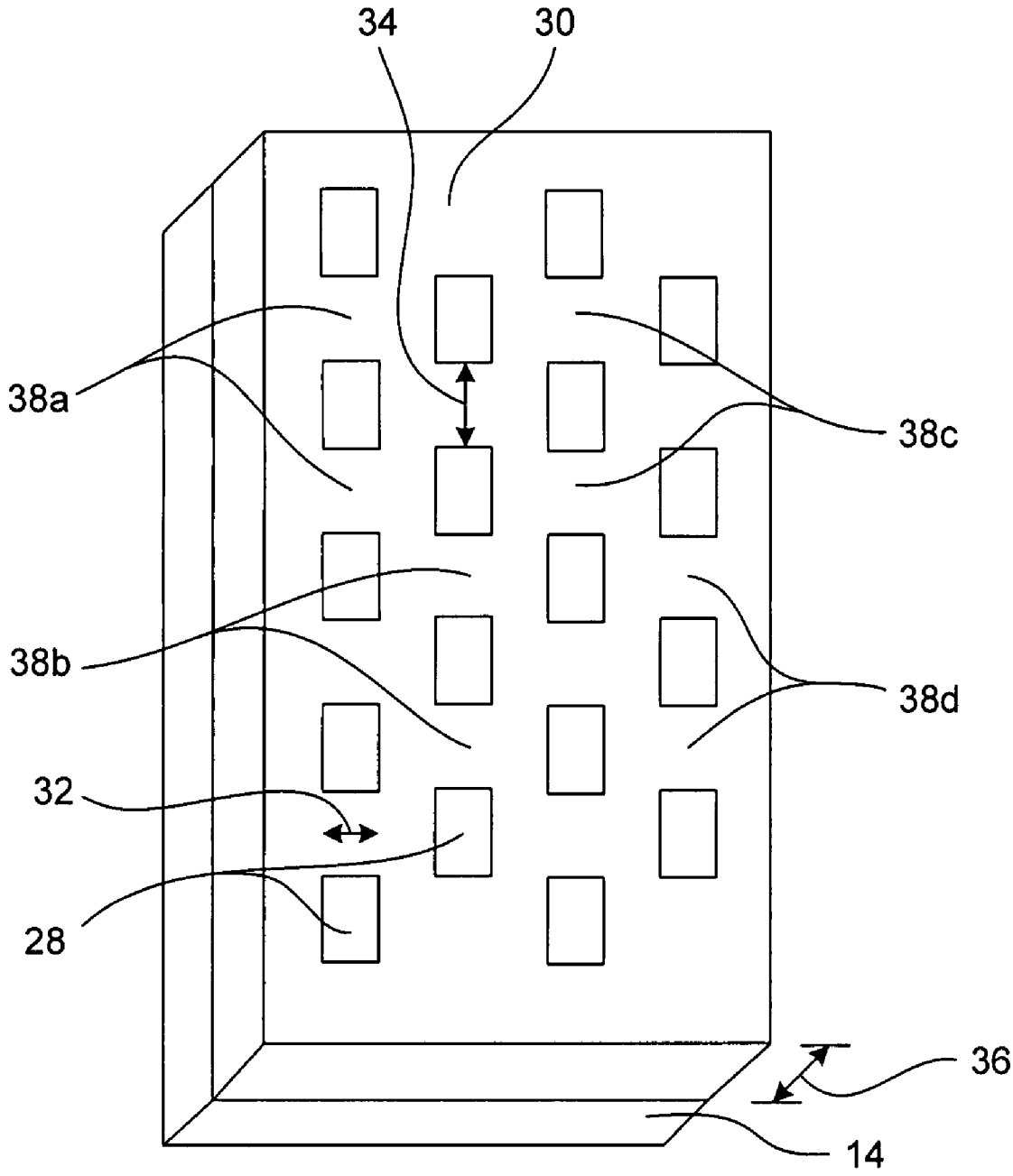
FIG. 2 is a predominately overhead three dimensional schematic view of the embodiment of the die slot of FIG. 1 reinforced with polymer ribs in the form of a modified polymer film in accordance with an embodiment of the present disclosure.
Figure 3:
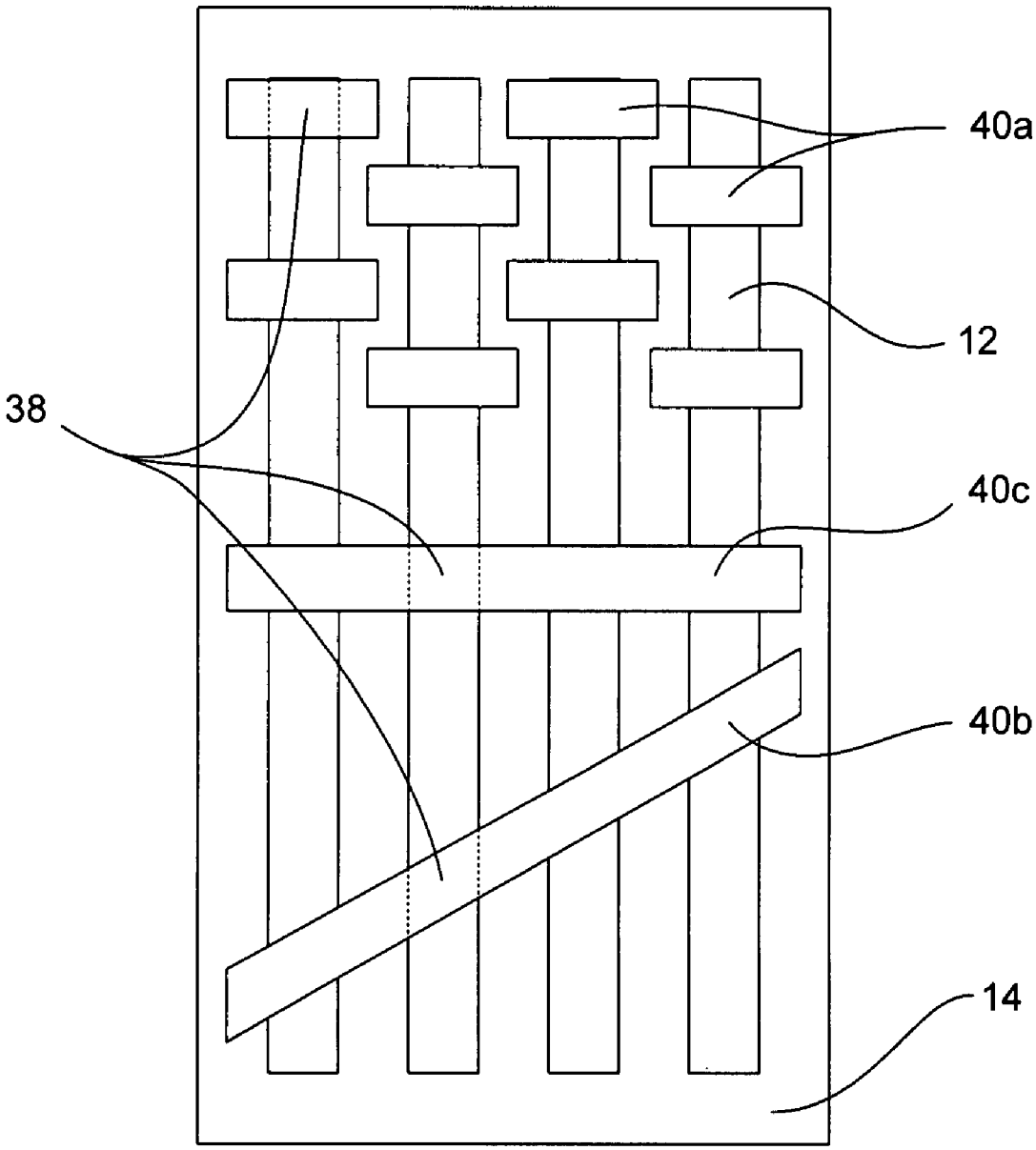
FIG. 3 is an overhead view of FIG. 1, reinforced with various types of polymer ribs in accordance with an embodiment of the present disclosure.

Turning now to FIG. 2 as it relates to a method of applying the polymer ribs, the polymer ribs 38*a*, 38*b*, 38*c*, 38*d* can be formed from a polymer film 30 that can be adhered to one side of the die structure 14 and subsequently modified to remove portions 28 of the film along the die slots (not shown in FIG. 2). As such, the polymer spans or bridges the slots thereby forming polymer ribs. The material can be removed through mechanical or chemical means including, but not limited to, cutting, milling, laser ablation, etching, or photo imaging. Alternately, as shown in FIG. 3, the polymer ribs 38 (shown spanning the die slots) can have numerous shapes and orientations. The polymer film 30 can be modified by chemical or mechanical means to form smaller polymer films 40*a*, 40*b*, 40*c* (shown in three different configurations) adhered to one side of the slotted die forming polymer ribs also referred to as bridged die slots. The smaller polymer films can span a single slot 40*a* or a plurality of die slots 40*b*, 40*c* (shown both at oblique angle and perpendicular compared to slots, respectively). The polymer ribs can be adhered to the slotted die in a number of patterns and positions. For example, FIG. 3 shows a generally alternating offset pattern with the smaller polymer films 40*a* substantially perpendicular to the die slot 12. However, other patterns may be used, such as a mixture of aligned smaller polymer films with offset smaller polymer films. Adaptations and variations to the patterns shown in FIG. 3 can be made without limitation by simply modifying the amount of polymer film to be removed. The smaller polymer films can have varying lengths, widths, and thickness depending on the desired strengthening to be achieved. Although the embodiments described herein have been generally used on one side, a two-sided polymer-ribbed reinforced die is also contemplated herein. As such, the embodiments described throughout the application are generally applicable to a two-sided polymer-ribbed embodiment as well.

Figure 4:
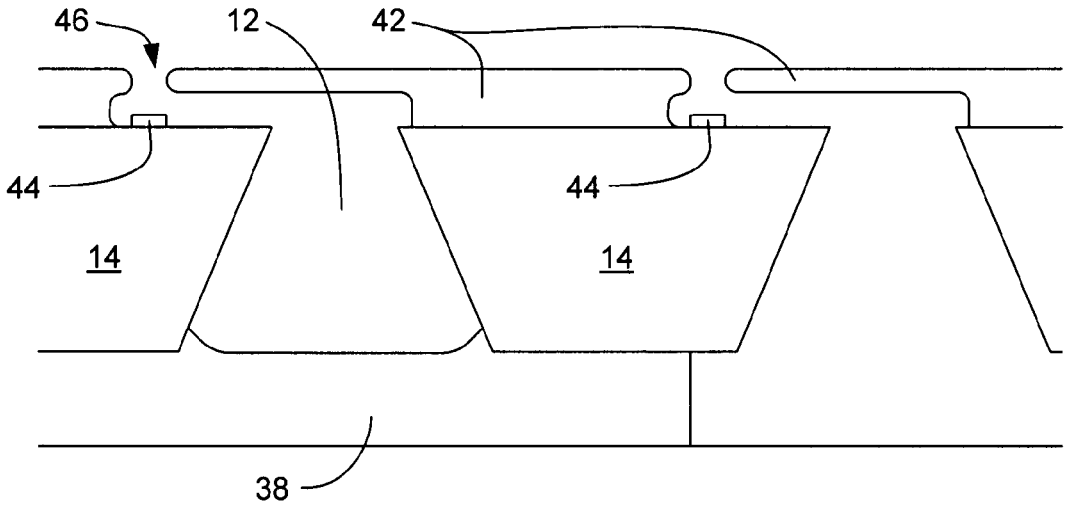
FIG. 4 is a cross-sectional schematic view of an embodiment of a typical pen architecture including polymer ribs in accordance with embodiments of the present disclosure.

Turning now to FIG. 4, a cross-sectional perspective is shown of a typical pen architecture having a polymer rib 38 spanning the die slot 12. The pen architecture includes a photoimageable polymer layer 42 adhered to the die structure 14 opposite the polymer rib 38. Typically, a resistor 44 is placed below an orifice 46 for controlling ink dispersion. As shown in FIG. 4, the polymer rib can flow along the walls of the die slot, wicking up into the die slot, and increase the bond length upon cure.

Figure 5:
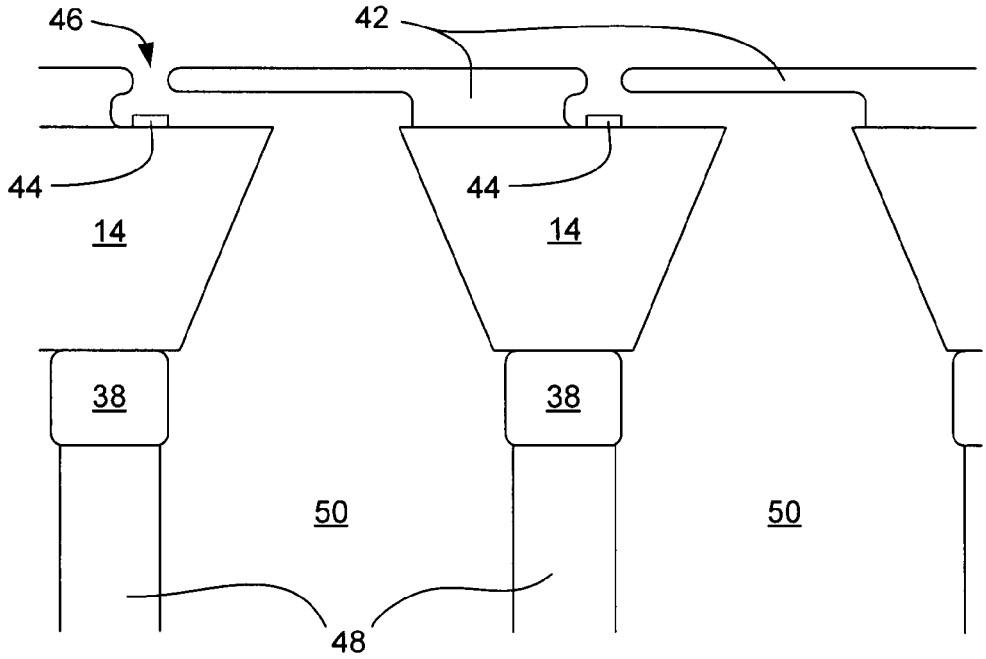
FIG. 5 is an alternate cross-sectional schematic view of an embodiment of a typical pen architecture including polymer ribs in accordance with embodiments of the present disclosure.

Turning now to FIG. 5, an additional alternate cross-sectional perspective is shown of a typical pen architecture having polymer ribs 38 between the die structure 14 and the pen body 48. As such, the polymer ribs can act as an adhesive between the printhead and the pen body. The area between adjacent pen bodies, polymer ribs, die structures, and photoimageable polymer layers 42 define an ink-flow channel 50. As such, the reinforced die structure can be used in a fluid ejection device having at least one fluid ejector and at least one nozzle such that the fluid ejection cartridge is configured to eject discrete drops having a volume of about 1 picoliter to about 20 picoliters. In one embodiment, the fluid ejector can be a resistor. In another embodiment, the fluid ejection cartridge can be a print cartridge.

Figure 6:
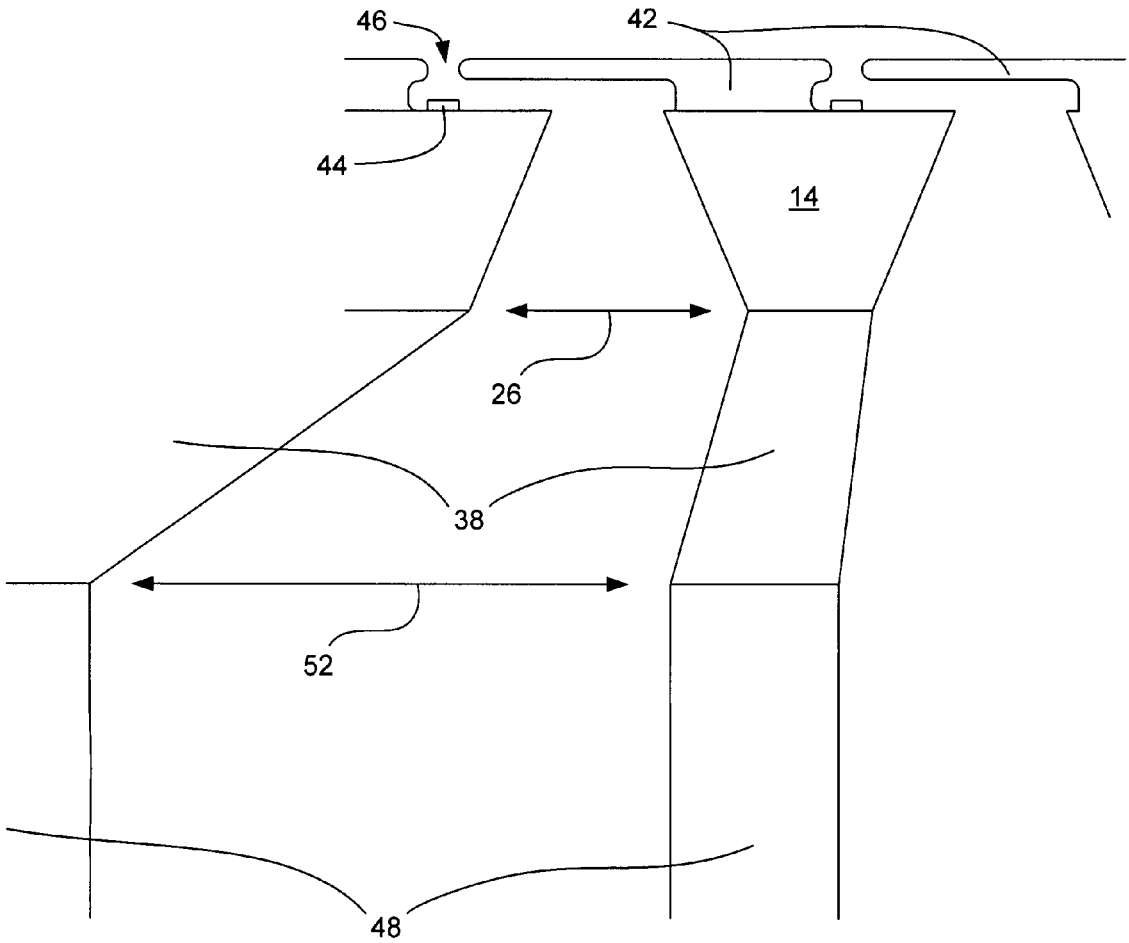
FIG. 6 is an additional alternate cross-sectional schematic view of an embodiment of a typical pen architecture including polymer ribs in accordance with embodiments of the present disclosure.

Turning now to FIG. 6, an alternate cross sectional perspective is shown of a typical pen architecture having polymer ribs 38 acting as an interposer. Adjacent die structures 14 have a slot width 26 partially defining the ink channel 46. The ink-flow channel is defined by the pen bodies 48, polymer ribs, die structures, and photoimageable polymer layers 42. The polymer ribs can be orientated such that the ink-flow channel width increases, thereby acting as an interposer between the pen bodies and the die structures. As shown in FIG. 6, the distance 52 between adjacent pen bodies is increased over the slot width 26. In one embodiment, the polymer ribs can be formed such that the distance between the pen bodies is double the width of the ink-flow channel, for example.

Although the embodiments described herein have been generally used on one side, a two-sided polymer-ribbed reinforced die is also contemplated herein. As such, the embodiments described throughout the application are generally applicable to a two-sided polymer-ribbed embodiment as well.

Additionally, polymer ribs can be pre-patterned on a large sheet of polymer film and an entire slotted silicon wafer can then be placed on top of this pre-patterned film. The film can then be partially cured to ensure adhesion between the wafer and the film. Typically, a coarse alignment can be performed. The wafer can then be sawn to singulate individual dies. The die can be placed on top of an interposer and then the adhesive can be fully cured under pressure to ensure good adhesion between the die and interposer.

Generally, as previously mentioned, the polymer ribs can have various shapes and dimensions. In one embodiment, as shown in FIG. 2, the polymer ribs 38 can have a width 34 of about 50 μm to about 300 μm and a length 32 of about 100 μm to about 500 μm with a thickness 36 of about 50 μm to about 150 μm. As such, the polymer ribs can reinforce the die structure 14 such that the polymer rib reinforced slotted die has a rigidity that is greater than 10 times the rigidity of the die without the polymer ribs. The polymer ribs can be spaced in various configurations or patterns. In one embodiment, as shown in FIG. 2, the polymer ribs 38*b* can be offset from other polymer ribs 38*a*, 38*c* on adjacent die slots. Alternately, the polymer ribs can be parallel to other polymer ribs on adjacent die slots.

The number of polymer ribs can vary depending on a number of factors, such as materials, amount of slots, ink demands, desired strength, etc. One skilled in the art will be able to design a slotted die having a number of polymer ribs for a desired application. In one embodiment, a slotted die of approximately 40 mm can have about 3 to 40 polymer ribs for each slot. Generally, the polymer ribs can be close enough to provide increased strength but spaced apart enough to allow proper ink flow without bubble or gas entrapment.

As previously mentioned, the polymer film and associated polymer ribs can be adhered to one side of the slotted die. In one embodiment, the polymer films can be partially cured on the slotted die. As such, the polymer can serve a dual function. For example, as previously described, in ink-jet printing heads, the polymer can serve as an interposer between the slotted die and the pen body. Additionally, the polymer films can serve as an adhesive between the die and the pen body. In accordance with this embodiment, once the polymer films are partially cured, the reinforced die can be seated in a printing apparatus and further cured such that polymer adheres the reinforced slotted die to the printing apparatus or pen body.

EXAMPLES

The following examples illustrate embodiments of the present disclosure that are presently known. Thus, these examples should not be considered as limitations of the present disclosure, but are merely in place to teach how to make the best-known compositions of the present disclosure based upon current experimental data. As such, a representative number of compositions and their method of manufacture are disclosed herein.

Example 1

Preparation of a Reinforced Dye Having Polymer Ribs

A silicon die with a length of 30 mm, width of 4 mm, and thickness of 700 μm is trenched forming 6 slots. The slotted wafer is laminated on the backside with a pre-patterned layer of thick adhesive. Alternatively, the wafer is laminated with a layer of SU8. The wafer is partially cured at a temperature of about 120° C. for about minutes. The non-rib area is then laser ablated thereby forming the polymer ribs. The die is then attached to a pen body and further cured at 180° C. for about 15 minutes. The overall increase in stiffness is about an order of magnitude.

Example 2

Preparation of a Reinforced Dye Having Polyimide Polymer Ribs

A pre-patterned polyimide with epoxy on either side (multilayer adhesive film) is pre-patterned with laser and then laminated on a wafer. The die is then singulated. Each die is about 4.2 mm wide, has 2 slots, and is 25.4 mm long. The polymer applied thereto is cured by heating the die and polymer to 120° C. for 20 minutes. In testing the strength of this die compared to a non-ribbed die as it relates to load and displacement to first failure increased by a factor of 4 and 2, respectively, in an out-of-plane mechanical test. Both load and displacements increased by a factor of 3 in an in-plane test.

While the disclosure has been described with reference to certain embodiments, those skilled in the art will appreciate that various modifications, changes, omissions, and substitutions can be made without departing from the spirit of the disclosure. It is intended, therefore, that the disclosure be limited by the scope of the following claims.

What is claimed is:

1. A die structure, comprising a die having a plurality of die slots, the die having polymer ribs attached to one side thereof, wherein the polymer ribs are attached using a polymer film applied to an entire side of the die, said polymer film having portions removed from the side along the die slots to form the polymer ribs which bridge the die slots, thereby forming a plurality of polymer bridged die slots.

2. The die of claim 1, wherein the polymer ribs are attached using a polymer film covering the entire die, said polymer film having portions removed along the die slots to form the polymer ribs which bridge the die slots.

3. The die of claim 2, wherein the polymer film covers a wafer.

4. The die of claim 1, wherein some polymer ribs are offset from other polymer ribs on adjacent die slots.

5. The die of claim 1, wherein the polymer ribs are of a material selected from the group consisting of polyimides, epoxies, thermoplastics, combinations thereof, and multi-layer polymer composites.

6. The die of claim 1, wherein the polymer ribs have a Young's modulus of at least 2 GPa, and wherein the die has a Young's modulus of at least 10 GPa, and wherein the reinforced die has a rigidity that is greater than 10 times the rigidity of the die without the polymer ribs.

7. The die of claim 1, wherein the die has a length from about 10 mm to about 50 mm, a width from about 1 mm to about 5 mm, and a thickness of about 0.2 mm to about 1 mm with 2 to 6 slots spaced about 0.3 mm to about 2 mm apart, said slots care about 10 mm to about 70 mm long and about 50 μm to about 500 μm wide and are substantially parallel.

8. The die of claim 1, wherein the polymer ribs have a width of 50 μm to about 300 μm and length of 100 μm to about 500 μm and a thickness of about 10 μm to about 150 μm.

9. The die of claim 1, wherein the polymer ribs have a concave shape or a flat shape.

10. The die of claim 1, wherein each die slot has about 3 to 40 polymer ribs associated therewith forming said bridged die slots.

11. The die of claim 1, wherein the die is used in a fluid ejection cartridge having at least one fluid ejector and at least one nozzle such that the fluid ejection cartridge is configured to eject discrete drops having a size of about 1 picoliter to about 20 picoliters.

12. The die of claim 11, wherein the fluid ejection cartridge is a print cartridge and the fluid ejector is a resistor.

13. The die of claim 1, wherein the polymer ribs act as an interposer between a printhead and a pen body.

* * * * *